US011402102B2

(12) United States Patent
Cowan

(10) Patent No.: US 11,402,102 B2
(45) Date of Patent: Aug. 2, 2022

(54) USER-CONFIGURABLE TWO-STEP ACTIVATION SEQUENCE FOR GAS COOKTOP BURNER

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 109 days.

(21) Appl. No.: 16/889,234

(22) Filed: Jun. 1, 2020

(65) Prior Publication Data

US 2021/0095855 A1 Apr. 1, 2021

Related U.S. Application Data

(63) Continuation-in-part of application No. 16/588,282, filed on Sep. 30, 2019.

(51) Int. Cl.
*F24C 3/12* (2006.01)
*F24C 3/08* (2006.01)

(52) U.S. Cl.
CPC ..... *F24C 3/124* (2013.01); *F24C 3/082* (2013.01)

(58) Field of Classification Search
CPC ..... F24C 3/124; F24C 3/082; F24C 3/126
See application file for complete search history.

(56) References Cited

U.S. PATENT DOCUMENTS 3,963,410 A 6/1976 Baysinger
4,930,488 A 6/1990 Pearman et al.
5,241,463 A * 8/1993 Lee ..... F24C 3/126 700/90
5,530,230 A * 6/1996 Smith ..... H05B 6/6435 219/723
5,575,638 A 11/1996 Witham et al.
5,662,465 A 9/1997 Kano
5,791,890 A 8/1998 Maughan
5,875,773 A * 3/1999 Jansen ..... F24C 3/126 126/42
5,924,857 A 7/1999 Frasnetti et al.
5,975,072 A 11/1999 Garceau et al.
6,992,258 B2 1/2006 Vieira
(Continued)

FOREIGN PATENT DOCUMENTS

CN 201531923 U 7/2010
CN 104033924 A 9/2014
(Continued)

OTHER PUBLICATIONS

U.S. Patent and Trademark Office, Office Action issued in U.S. Appl. No. 16/588,282 dated Feb. 4, 2021.
(Continued)

*Primary Examiner* — Umashankar Venkatesan
(74) *Attorney, Agent, or Firm* — Middleton Reutlinger

(57) ABSTRACT

A cooking appliance and system for a two-step activation for a gas cooktop burner includes at least one control selector having an output representative of a valve position and a touch sensor having an output representative of a permission to operate the valve, with a user-configurable two-step activation sequence used to control a digital gas valve and an ignitor for the gas cooktop burner to ignite and activate the gas cooktop burner.

18 Claims, 6 Drawing Sheets

(56) References Cited

U.S. PATENT DOCUMENTS

| | | | | |
|---|---|---|---|---|
| 7,479,006 | B2 * | 1/2009 | Newsom | F24C 3/12 431/12 |
| 7,642,673 | B2 | 1/2010 | Baier | |
| 7,798,139 | B2 | 9/2010 | Gagas et al. | |
| 7,978,186 | B2 | 7/2011 | Vassallo et al. | |
| 8,587,444 | B2 | 11/2013 | Cadima | |
| 8,766,910 | B2 | 7/2014 | Grivna | |
| 2004/0069293 | A1 * | 4/2004 | Steurer | F24C 3/126 126/39 R |
| 2005/0115697 | A1 | 6/2005 | Landry et al. | |
| 2005/0236392 | A1 * | 10/2005 | Blackson | H05B 3/68 219/446.1 |
| 2008/0108002 | A1 * | 5/2008 | Huang | F23N 5/102 431/80 |
| 2009/0104573 | A1 * | 4/2009 | Chen | F24C 3/103 431/72 |
| 2009/0189747 | A1 * | 7/2009 | Baier | G06F 3/016 340/407.1 |
| 2011/0294078 | A1 | 12/2011 | Gärtner et al. | |
| 2012/0171343 | A1 * | 7/2012 | Cadima | F24C 7/082 426/520 |
| 2012/0305820 | A1 | 12/2012 | Bollman et al. | |
| 2014/0199641 | A1 | 7/2014 | Chian et al. | |
| 2015/0374163 | A1 * | 12/2015 | Span | F24C 3/124 426/231 |
| 2018/0084937 | A1 | 3/2018 | Joo et al. | |
| 2018/0340692 | A1 | 11/2018 | Kwag et al. | |
| 2019/0125120 | A1 | 5/2019 | Jenkins et al. | |
| 2019/0170364 | A1 | 6/2019 | Ha et al. | |
| 2020/0088411 | A1 | 3/2020 | Cowan et al. | |
| 2021/0095784 | A1 | 4/2021 | Cowan et al. | |

FOREIGN PATENT DOCUMENTS

| | | | |
|---|---|---|---|
| CN | 204438219 | U | 7/2015 |
| CN | 104976646 | A | 10/2015 |
| CN | 105008807 | A | 10/2015 |
| CN | 105928018 | A | 9/2016 |
| CN | 109140534 | A | 1/2019 |
| CN | 208794462 | U | 4/2019 |
| EP | 2230461 | A2 | 9/2010 |
| WO | WO2010039439 | A3 | 7/2010 |

OTHER PUBLICATIONS

U.S. Patent and Trademark Office, Advisory Action issued in U.S. Appl. No. 16/588,282 dated Oct. 29, 2021.

International Search Report and Written Opinion issued in Application No. PCT/CN2020/097873, dated Sep. 27, 2020.

International Search Report and Written Opinion issued in Application No. PCT/CN2021/097352, dated Aug. 24, 2021.

U.S. Patent and Trademark Office, Final Office Action issued in U.S. Appl. No. 16/588,282 dated Jul. 15, 2021.

Lee "This Smart Knob Upgrades Your Stove with Automatic Temperature Controls" https://www.engadget.com/2015/04/07/meld-knob-clip/ Apr. 2015.

U.S. Patent and Trademark Office, Notice of Allowance issued in U.S. Appl. No. 16/588,282 dated Nov. 29, 2021.

* cited by examiner

USER-CONFIGURABLE TWO-STEP ACTIVATION SEQUENCE FOR GAS COOKTOP BURNER

BACKGROUND OF THE INVENTION

In appliance manufacturing industries generally, and specifically in the range or cooking appliance manufacturing industries, most appliances such as cooktops or ranges have a variety of control or selector knobs for adjusting and controlling the amount of heat supplied to the various appliance burners or heating elements. Typically, these knobs are easily accessible to the average user, thereby making them simple and quick to operate, but also providing ready access to children and others lacking the requisite judgment to safely operate the appliance.

In order to provide a measure of safety to oven and cooktop appliances, manufacturers have equipped some control knobs and selectors with simple lockout mechanisms. For example, some control knobs are mounted on spring-loaded shafts that require a user to push or depress the knob slightly before it will turn, thereby providing at least a small measure of child-safety lockout protection. Gas appliances are typically equipped with these push-unlock valves as a mechanism to prevent accidental valve operation but they do not offer a reliable safety lockout mechanism.

Household cooking gas appliances in the United States are certified to the ANSI Z21.1 standard. This standard states that "Any manual gas valve or energy controlling device intended for use during normal operation and that has an off position to shut off the gas to a main burner or the energy flow to a heating element shall necessitate not less than two separate manual operations to turn on and shall necessitate only one manual operation to turn off." Typically, many standard manual gas valves are made to open from the closed position by first pushing in and then turning, for example.

However, many appliances utilize "digital" gas valves wherein a control knob is connected or secured to an electrical component, for example a resolver or encoder, that then translates the rotational position of the valve into an electrical signal representative of desired valve positioned to an electrically actuated gas valve to control the burner. In the case of these digital valves there is a need to design a method of interface for the user to command the valves to open and close, incorporating at least two manual operations to open and only one to close, in order to provide safe operation of the valves and concomitant burners.

Some digital gas systems utilize use a system of touch controls for safety purposes. For example, a user may touch a button or control panel switch to select a burner, then touch another button to ignite it and others to raise and lower the power level. Various other child lockout systems have been provided in the industry, with varying degrees of safety and operability. There does not exist, however, a reliable system for providing child safety control to an appliance that simultaneously provides ease of access and use for an adult user and permits a user to configure the operation of the burner and valve.

From the foregoing it can readily be seen that there is a need in the art for a gas valve control system that utilizes a multi-step process, for example a two-step turn on process and concomitant knob or actuator system that can be employed with individual appliances to control access to appliance controls without hampering the ability to use the appliance.

SUMMARY OF THE INVENTION

A cooking appliance and system for a two-step activation for a gas cooktop burner may include at least one control selector having an output representative of a valve position and a touch sensor having an output representative of a permission to operate the valve, with a user-configurable two-step activation sequence used to control a digital gas valve and an ignitor for the gas cooktop burner to ignite and activate the gas cooktop burner.

Therefore, consistent with one aspect of the invention, a cooking appliance may include a plurality of gas cooktop burners, a plurality of digital gas valves associated with the plurality of gas cooktop burners, each digital gas valve configured to couple an associated gas cooktop burner from among the plurality of gas cooktop burners to a gas supply, a plurality of control selectors associated with and assigned to the plurality of gas cooktop burners and having respective outputs representative of valve positions of the digital gas valves for the associated gas cooktop burners, one or more touch sensors, a plurality of ignitors disposed proximate associated gas cooktop burners among the plurality of gas cooktop burners to ignite the associated gas cooktop burners, and a controller coupled to the plurality of control selectors, the one or more touch sensors, the plurality of gas valves and the plurality of ignitors, the controller configured to control the associated digital gas valve and the associated ignitor for a selected gas cooktop burner among the plurality of gas cooktop burners to ignite the selected gas cooktop burner in response to a two-step activation sequence initiated in response to user input directed to the one or more touch sensors and to the associated control selector for the selected gas cooktop burner, and the controller further configured to customize the two-step activation sequence in response to user input.

In some embodiments, the two-step activation sequence is a first two-step activation sequence, customizing the first two-step activation sequence generates a second two-step activation sequence that is different from the first two-step activation sequence, and the controller is further configured to, after customizing the first two-step activation sequence, control the associated digital gas valve and the associated ignitor for the selected gas cooktop burner among the plurality of gas cooktop burners to ignite the selected gas cooktop burner in response to the second two-step activation sequence initiated in response to user input directed to the one or more touch sensors and to the associated control selector for the selected gas cooktop burner. Also, in some embodiments, the first and second two-step activation sequences are among a plurality of stored two-step activation sequences, and the controller is configured to customize the two-step activation sequence in response to user input that selects a stored two-step activation sequence among the plurality of two-step activation sequences.

Further, in some embodiments, the controller is configured to customize the two-step activation sequence by changing an activation order of the one or more touch sensors and the associated control selector. In some embodiments, prior to customizing the two-step activation sequence, the two-step activation sequence includes activation of the one or more touch sensors prior to activation of the associated control selector for the selected gas cooktop burner, and changing the activation order includes modifying the two-step activation sequence to include activation of the associated control selector for the selected gas cooktop burner prior to activation of the one or more touch sensors. In addition, in some embodiments, prior to customizing the two-step activation sequence, the two-step activation sequence includes activation of the associated control selector for the selected gas cooktop burner prior to activation of the one or more touch sensors, and changing the activation order includes modifying the two-step activation sequence to include activation of the one or more touch sensors prior to activation of the associated control selector for the selected gas cooktop burner.

In some embodiments, the controller is configured to customize the two-step activation sequence by changing an activation order of the one or more touch sensors and the associated control selector for the selected gas cooktop burner to require simultaneous activation of the one or more touch sensors and the associated control selector for the selected gas cooktop burner. In addition, in some embodiments, the one or more touch sensors includes a global touch sensor having an output representative of a permission to operate any of the plurality of gas cooktop burners. In addition, some embodiments may further include a user interface coupled to the controller, and the global touch sensor is a user interface control provided on the user interface. In some embodiments, the global touch sensor is a physical device disposed on a surface of the cooking appliance.

Moreover, in some embodiments, the one or more touch sensors includes a plurality of touch sensors for the plurality of gas cooktop burners, each touch sensor having an output representative of a permission to operate an associated gas cooktop burner among the plurality of gas cooktop burners. In some embodiments, the one or more touch sensors includes a global touch sensor having an output representative of a permission to operate any of the plurality of gas cooktop burners and a plurality of burner-specific touch sensors for the plurality of gas cooktop burners, each burner-specific touch sensor having an output representative of a permission to operate an associated gas cooktop burner among the plurality of gas cooktop burners, and the controller is configured to customize the two-step activation sequence by changing between use of the global touch sensor in the two-step activation sequence and use of the burner-specific touch sensor for the selected gas cooktop burner in the two-step activation sequence.

In addition, in some embodiments, the controller is further configured to shut off the selected gas cooktop burner in response to user input directed to the burner-specific touch sensor for the selected gas cooktop burner when the selected gas cooktop burner is active and regardless of whether the burner-specific touch sensor is used in the two-step activation sequence. In some embodiments, the controller is further configured to control the associated digital gas valve to set an initial output level of the gas cooktop burner in response to the two-step activation sequence. Moreover, in some embodiments, the controller is configured to customize the two-step activation sequence by changing the initial output level of the gas cooktop burner for the two-step activation sequence. Also, in some embodiments, the one or more touch sensors includes a capacitive touch sensor, a mechanical switch, an electromechanical switch or an electromechanical switch that is activated by depressing the associated control selector for the selected gas cooktop burner.

In some embodiments, the associated control selector for the selected gas cooktop burner includes a rotatable knob, and the two-step activation sequence includes rotation of the rotatable knob in a predetermined direction. In addition, in some embodiments, the selected gas cooktop burner is a first gas cooktop burner, the two-step activation sequence is a first two-step activation sequence associated with the first gas cooktop burner, and the controller is configured to control the associated digital gas valve and the associated ignitor for a second gas cooktop burner among the plurality of gas cooktop burners to ignite the second gas cooktop burner in response to a second two-step activation sequence that is different from the first two-step activation sequence.

Consistent with another aspect of the invention, a system for a two-step activation for a plurality of gas cooktop burners having associated digital gas valves coupled to a gas supply and associated ignitors disposed proximate thereto may include a plurality of control selectors associated with and assigned to the plurality of gas cooktop burners and having respective outputs representative of valve positions of the digital gas valves for the associated gas cooktop burners, one or more touch sensors, and a controller coupled to the plurality of control selectors and the one or more touch sensors, the controller configured to control the associated digital gas valve and the associated ignitor for a selected gas cooktop burner among the plurality of gas cooktop burners to ignite the selected gas cooktop burner in response to a two-step activation sequence initiated in response to user input directed to the one or more touch sensors and to the associated control selector for the selected gas cooktop burner, and the controller further configured to customize the two-step activation sequence in response to user input.

Consistent with another aspect of the invention, a system for a two-step activation for a gas cooktop burner having an associated digital gas valve coupled to a gas supply and an associated ignitor disposed proximate thereto to ignite the gas cooktop burner may include a control selector associated with and assigned to the gas cooktop burner and having an output representative of a valve position of the digital gas valve, a touch sensor, and a controller coupled to the control selector and the touch sensor, the controller configured to control the digital gas valve and the ignitor for the gas cooktop burner to ignite the gas cooktop burner in response to a two-step activation sequence initiated in response to user input directed to the touch sensor and to the control selector for the gas cooktop burner, and the controller further configured to customize the two-step activation sequence in response to user input.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure.

DETAILED DESCRIPTION OF THE INVENTION

Figure 1:
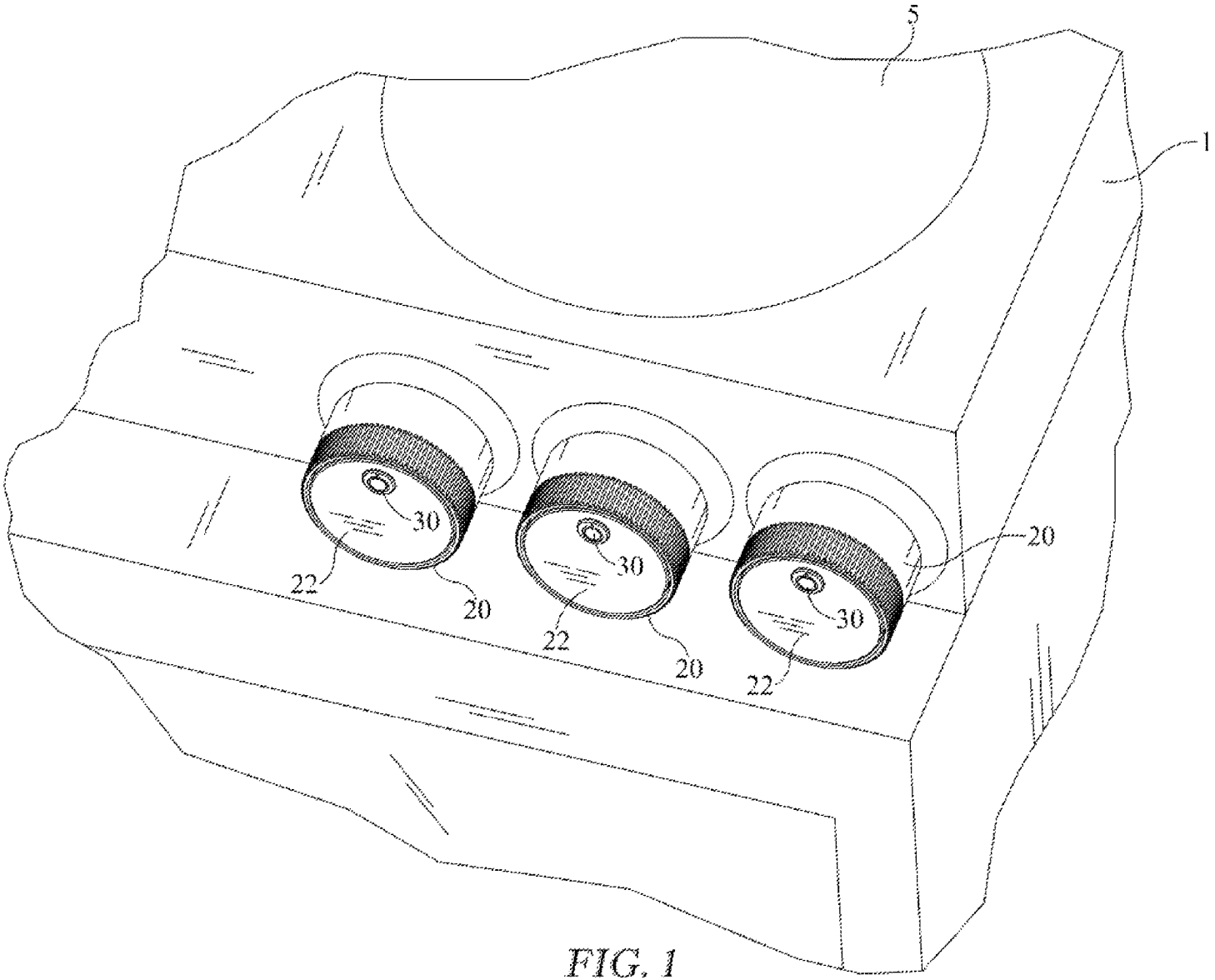
FIG. 1 is a perspective view of a gas appliance having a plurality of control knobs in accordance with various embodiments.
Figure 2:
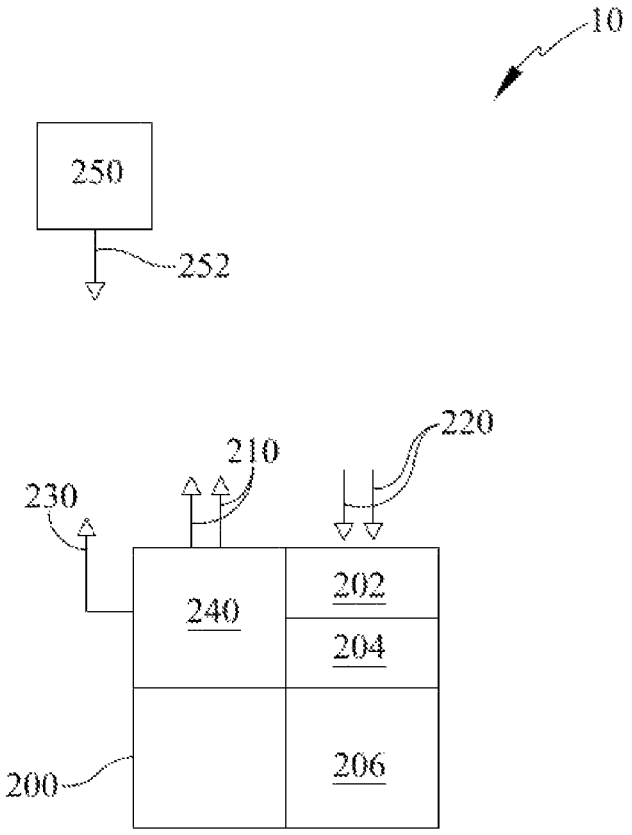
FIG. 2 is a block diagram of a control system that may be used in conjunction with an appliance in accordance with various embodiments.

Referring to drawing FIGS. 1 and 2, and in accordance with various aspects and embodiments of the invention, a system 10 for a two-step turn on for an appliance 1 gas control valve is described. In various embodiments the appliance 1 in which system 10 is implemented may include a controller 200 integral to appliance 1 that operates appliance 1 and implements various embodiments and aspects of system 10 as described herein.

FIG. 2 illustrates an exemplary appliance 1 hardware environment for implementing system 10 for two-step valve control and operation. The system 10 may include a controller 200, a processor or processors 202 and concomitant memory 204. Appliance 1 controller 200 may further comprise a plurality of signal outputs 210 and signal inputs 220 that may be operatively connected to a plurality of appliance 1 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator or user interface 250 to provide audible or visual feedback to a user as well as provide a user the ability to provide instructions or commands to controller 200. Exemplary but non-limiting user interfaces 250 that may be employed include a mouse, keypads, touch-screens, keyboards, switches and/or touch pads. Any user interface may be employed for use in the invention without departing from the scope thereof. It will be understood that FIG. 2 constitutes, in some respects, an abstraction and that the actual organization of the components of appliance 1 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 250 may include one or more devices for enabling communication with a user such as an administrator. For example, the user interface 250 may include a display, a mouse, and a keyboard for receiving user commands. In some embodiments, the user interface 250 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Figure 3:
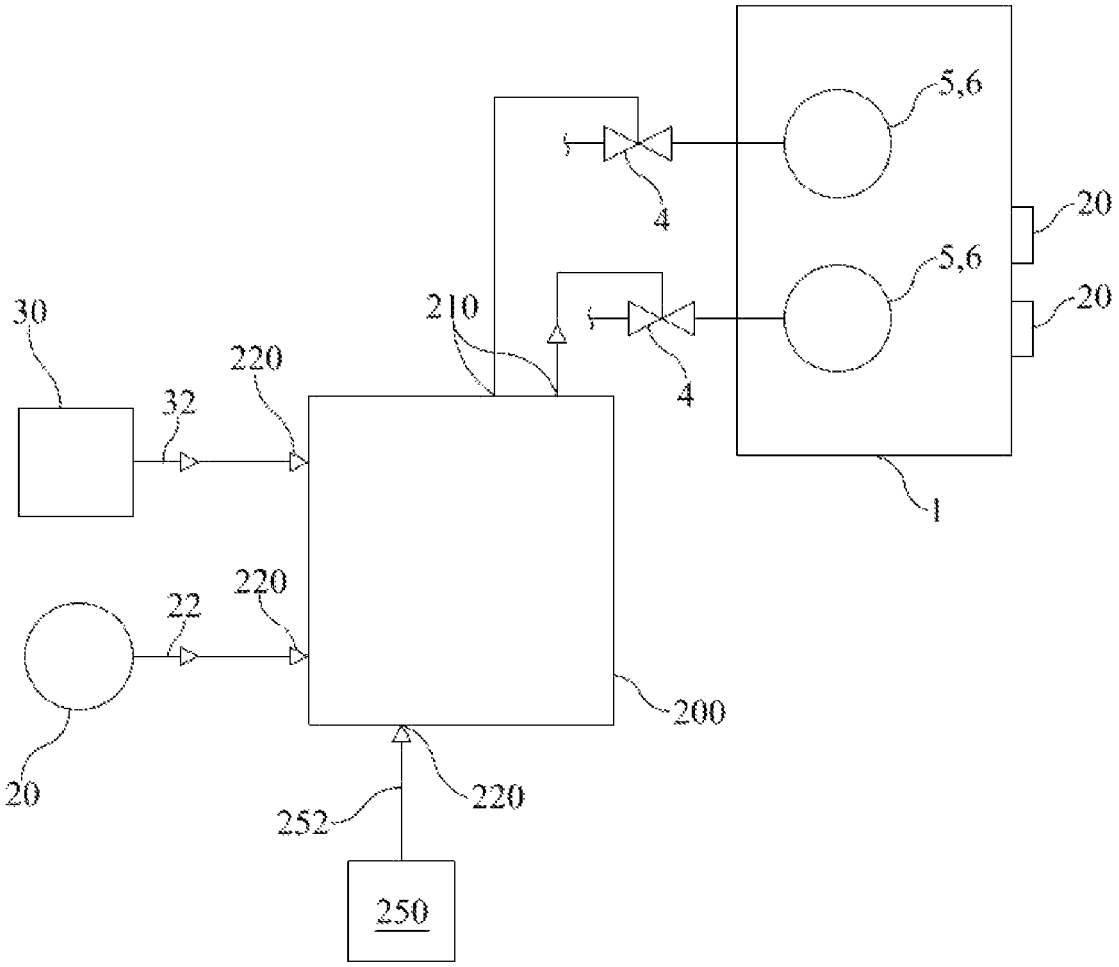
FIG. 3 is a block diagram of a valve control system in accordance with various embodiments.

Referring again to FIGS. 1-3, and in accordance with some embodiments, a system 10 for implementing a two-step gas valve turn-on for an appliance 1 includes a plurality of control knobs 20 (alternatively selector knobs 20), that are utilized to operate a plurality of digital gas valves of appliance 1. It should be understood that any appliance 1 or other device that utilizes control or selector knobs 20 wherein it would be desirable to implement a two-step initiation process may be implemented as part of system 10 without departing from the scope of the invention.

In one non-limiting exemplary embodiment for purposes of illustration in this specification, appliance 1 may be a gas stove 1, (or equivalently a cooktop and oven combination). Stove 1 may include multiple control knobs 20, for example control knobs to adjust the flow of gas to a plurality of gas valves 4, and thus the heat output (or output level) of a plurality of cooktop burners 5, as well as a plurality of oven heating elements or burners (not shown). In some aspects appliance 1 may include only one control knob that is assigned to individual valves 4 and concomitant burners 5. Other control knobs 20 for adjusting or operating various appliance 1 controls may also be present, but for purposes of explication have been omitted from this example. In one exemplary but non-limiting embodiment that will be used throughout this specification for purposes of explication, the control knobs 20 may be assumed to operate a plurality of gas valves 4, for example valves 4 supplying gas cooktop burners 5 and/or gas oven burners 5. In some aspects and embodiments control knobs 20 are turned or rotated clockwise to supply additional gas (and therefore heat) to a selected burner 5, and conversely turned counter-clockwise to reduce the amount of gas (and therefore heat) to a selected burner 5. In some aspects and embodiments control knobs may be rotated in a first direction to increase the open position of valve 4 and rotated in the opposite direction to reduce the open position of valve 4.

In some aspects of the invention the plurality of control knobs 20 may be mounted to or secured to a plurality of encoders that supply a plurality of inputs 220 to controller 200 representative of a desired gas valve 4 position (or burner 5 heat or output level), whereby controller 200 provides corresponding outputs 210 to control the plurality of gas valves 4.

In accordance with some aspects of the disclosure system 10 provides a plurality of two-step methods and concomitant apparatus for implementing a two-step turn on for a gas valve 4. In one exemplary embodiment appliance 1 includes at least one control knob 20 for setting a desired valve 4 position, or alternatively burner 5 power or output level. Throughout the specification gas valve 4 position and burner 5 power level, output level and/or heat level will be referred to interchangeably. It should be understood that the position of a specified gas valve 4 will dictate the power level, output level and/or heat level of that burner 5.

Control selectors 20 may include an output 22 that is representative of valve 4 position or power level, operatively coupled to an input of 220 of controller 200. Controller 200 will then supply, when conditions precedent are satisfied as discussed herein below, an output 210 representative of valve 4 position to valve 4, and/or an ignition output 210 to a valve igniter 6 to ignite valve 6 at a desired power level.

System 10 may further include a touch element or sensor 30 that must be touched, selected, depressed, or otherwise contacted or chosen by a user to activate a gas valve 4 assigned to a control knob 20. In some exemplary embodiments and aspects touch element 30 may be a capacitive touch sensor. In other embodiments touch element 30 may be a mechanical, electrical, or electro-mechanical switch. In some additional embodiments touch element 30 may be a programmed button or selection on operator interface 250 such that a user must select or touch the user interface in the prescribed method to activate gas valve 4.

In yet further aspects and embodiments, operator interface 250 may include a voice recognition module that may be programmed to operate in place of touch sensor 30, for example to recognize a specific voice or voices. In these embodiments voice recognition module may include an output 252 operatively coupled to processor 200 that is provided when a predetermined voice is detected by module 250. In these embodiments, a specific vocal command such as "burner on", "activate burner", or "ignite", may be pre-programmed by a user to cause processor to provide an output 210 to valve 4 actuators to operate valves 4 responsive to a control knobs 20 position.

In yet further aspects and embodiments, and as best depicted in FIG. 1, control knobs 20 may include a separate touch-sensitive button 30 disposed in a front surface 22 of knob 20 that may incorporate aspects of access control for an appliance. Each touch sensitive button 30 may provide an input 220 to processor 200 to indicate its selection by a user. In one exemplary embodiment, a user may initiate valve 4 operation and/or ignition by simultaneously touching or selecting the touch-sensitive button 30 on a specific selector 20 and rotating the selector to a desired burner power level. In an exemplary embodiment where appliance 1 is a stove, oven, or cooktop, the selected burner 4 ignitor is then provided an output 210 from controller 200 and valve 4 is provided an output 210 representative of desired valve 4 position, thereby igniting and setting the burner heat level.

In accordance with some embodiments, in operation, operator interface 250 may be provided with suitable programming instructions to depict or represent a touch button or selector 30 that operates just as a mechanical switch would. When operator interface 250 switch 30 is selected and valve selector 20 has been turned, processor 200 provides an output 220 to valve 4 and ignitor 6 to operate burner 5.

In some aspects and embodiments of the invention control selector 20 must be first be turned to a desired burner 5 power level prior to a user touching or depressing the touch sensor 30 in order for processor 200 to initiate ignition of burner 5 at the desired power level. In some embodiments wherein control selector 20 is a rotatable knob, control selector may be turned in either direction to set the predetermined power level of burner 5. In these aspects and embodiments burner 5 may be turned off by simply touching or activating touch sensor 30.

In some additional aspects and embodiments of the invention touch sensor 30 must be touched or activated prior to control selector 20 being turned to a desired burner 5 power level in order for processor 200 to initiate ignition of burner 5 at the desired power level. In some embodiments wherein control selector 20 is a rotatable knob, control selector may be turned in either direction, either clockwise or counter clockwise, to set the predetermined power level of burner 5. In these aspects and embodiments burner 5 may be turned off by simply touching or activating touch sensor 30.

In accordance with additional aspects and embodiments of the invention a single control selector 20 or knob may be utilized to operate a plurality of valves 4 and concomitant burners 5. In these embodiments user interface 250 may be suitably programmed such that a user may choose a burner 5 to be controlled via a selection graphic or button on the operator interface. The user may the operate burner 5 according to the system and method described herein. In other aspects a single touch sensor 30 may be provided in conjunction with appliance 1 or user interface 250, wherein the touch sensor is operable to control the ignition of a burner 5 that is selected through the use of operator interface 250. In yet further embodiments where a single control selector 20 is employed, each burner 5 may include a dedicated touch sensor 30 to initiate ignition thereof as described herein.

In a yet further embodiment, control selector or knob 20 may include an electromechanical switch that is actuated responsive to pushing in or depressing selector 20 so that a user must push in or "click" control selector 20 prior to selecting a power level for burner 5 by rotating selector 20. In this embodiments the electromechanical switch includes an output operatively coupled to an input of controller 200 that indicates that a user is ready to light a selected burner 5. Alternatively, control selector 20 may be rotated to a desired power level prior to pushing in or clicking selector 20 to ignite burner 5.

Figure 4:
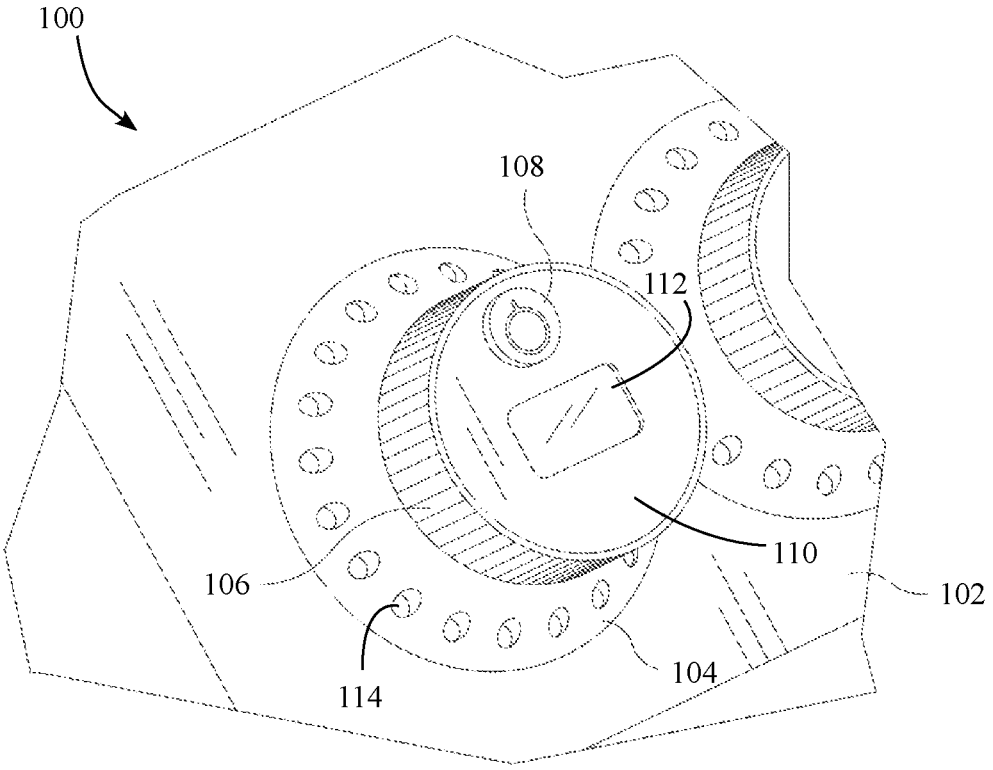
FIG. 4 is a detail view of a control knob with an integrated touch sensor and display in accordance with various embodiments.
Figure 5:
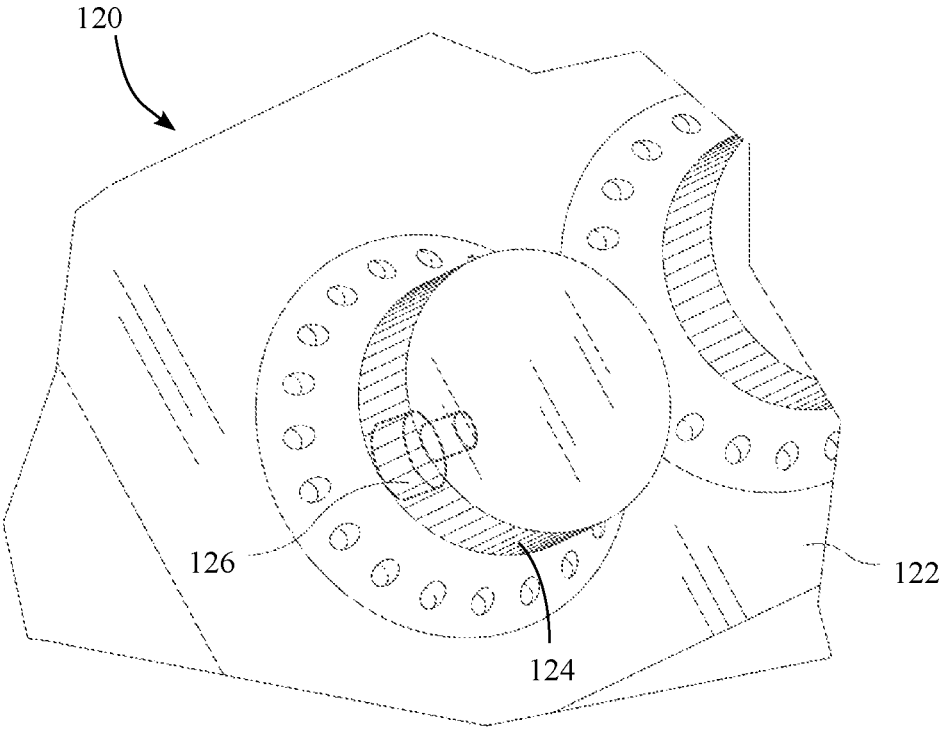
FIG. 5 is a detail view of a depressible control knob in accordance with various embodiments.

FIGS. 4 and 5 illustrate various additional control selector and touch sensor configurations that may be used in various embodiments. FIG. 4, for example, illustrates a portion of a cooking appliance 100 including a front panel 102 with one or more control selectors 104, each having a rotatable ring 106 and a touch sensor 108 disposed on a stationary front face or surface 110 thereof. Additional user interface components, e.g., a status display 112 and a series of lights 114, may also be provided on each control selector 104 to provide additional status information, e.g., an output level, an on/off status, a "hot burner" status, a temperature, a burner assignment, etc. In some embodiments, for example, where control selectors may be reassigned to different burners, a current assignment may be displayed on status display 112. Other status information may be provided, for example, via printed or illuminated displays on panel 102 disposed proximate each control selector in some embodiments.

FIG. 5, as another example, illustrates a portion of a cooking appliance 120 including a front panel 122 with one or more control selectors 124, each being configured as a rotatable knob and having a touch sensor 126 implemented as an switch that is actuated responsive to pushing in or depressing control selector 124 along its axis of rotation.

Other control selector and touch sensor configurations beyond those described herein may be utilized in other embodiments. Therefore, the invention is not limited to the specific configurations described herein.

As noted above, in some embodiments, the two-step activation sequence utilized to ignite a burner in a cooking appliance may be user configurable, i.e., such that the two-step activation sequence may be customized or modified in response to user input. Thus, in some embodiments, a cooking appliance may include one or more gas cooktop burners, and for each gas cooktop burner, an associated digital gas valve, ignitor and control selector may be provided therefor. The digital gas valve may be used to couple the gas cooktop burner to a gas supply and regulate gas flow thereto, and the ignitor may be disposed proximate the gas cooktop burner and used for igniting the same. The control selector may be assigned to the gas cooktop burner, either via a permanent assignment or a user-configurable assignment, and may have an output representative of a valve position of the associated digital gas valve for the gas cooktop burner. A control selector may also be permanently or configurably assignable to multiple gas cooktop burners, e.g., where burner groups are supported.

Figure 6:
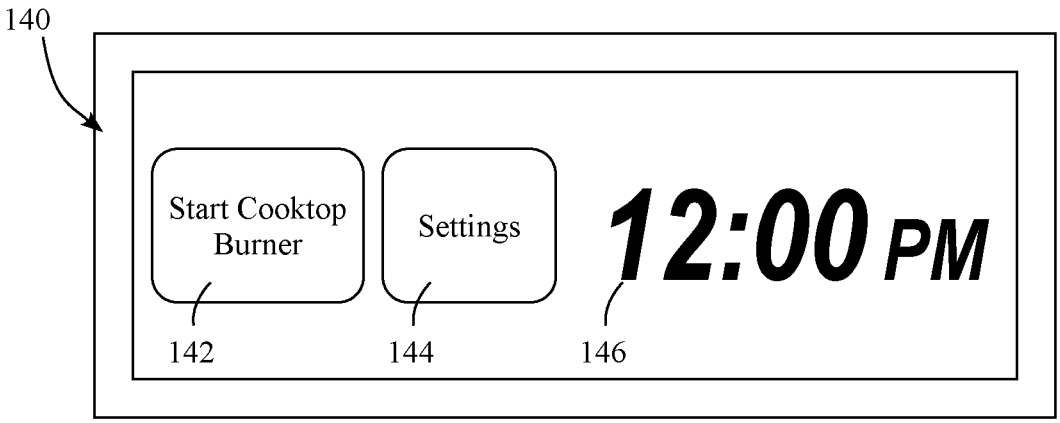
FIG. 6 is a front view of an example user interface in accordance with various embodiments, and illustrating a main display.

One or more touch sensors may also be provided, and may be configured in a number of different manners in different embodiments. Touch sensors, as noted above, may be implemented using various physical devices disposed on a cooking appliance, e.g., capacitive sensors, mechanical switches, electrical switches, or electromechanical switches, or alternatively implemented as a "soft" button, e.g., programmed buttons, selections or other user interface controls on a touch screen or other user interface, among other variations. Examples of the former, for example, include touch sensor 30 of FIG. 1, touch sensor 108 of FIG. 4 and touch sensor 126 of FIG. 5, while an example of the latter is depicted in FIG. 6, which illustrates a touch screen user interface 140 for a cooking appliance that may be disposed, for example, on a top or front panel of the cooking appliance. User interface 140 depicts a soft button 142 labeled "start cooktop burner," which may be used as a touch sensor in some embodiments.

It will be appreciated that user interface 140 is greatly simplified for explanatory purposes, and shows only an additional soft button 144 for accessing appliance settings and a clock display 146. It will be appreciated that for various cooking appliances, user interface 140 may depict a wide variety of information, e.g., oven controls, burner controls, temperature displays, timer displays, etc.

In addition, in various embodiments, one touch sensor may be configured as a global touch sensor that is used for the two-step activation sequence for multiple gas cooktop burners, and having an output representative of a permission to operate any of the multiple gas cooktop burners. An example of such a touch sensor is soft button 142 of FIG. 6, although it will be appreciated that a physical device (e.g., disposed on a surface of the cooking appliance) may be used as a global touch sensor in other embodiments. In addition, in some embodiments, burner-specific touch sensors, disposed on or proximate to individual control selectors, may be used, with each having an output representative of a permission to operate the gas cooktop burner for the control selector with which the burner-specific touch sensor is associated. Examples of such burner-specific touch sensors include touch sensors 30, 108 and 126 of FIGS. 1, 4 and 5, although it will be appreciated that soft buttons or other user interface controls may be used as burner-specific touch sensors in other embodiments.

Furthermore, touch sensors in some embodiments may be utilized additionally as "off" switches suitable for shutting off a gas cooktop burner when it is desired to discontinue use thereof (e.g., as is the case for any of touch sensors 30, 108, 126 and 142 of FIGS. 1, 4, 5 and 6). In other embodiments, however, separate off switches may be used, or shutting off of a gas cooktop burner may be implemented using other controls (e.g., by turning a control selector to a minimum position).

Figure 7:
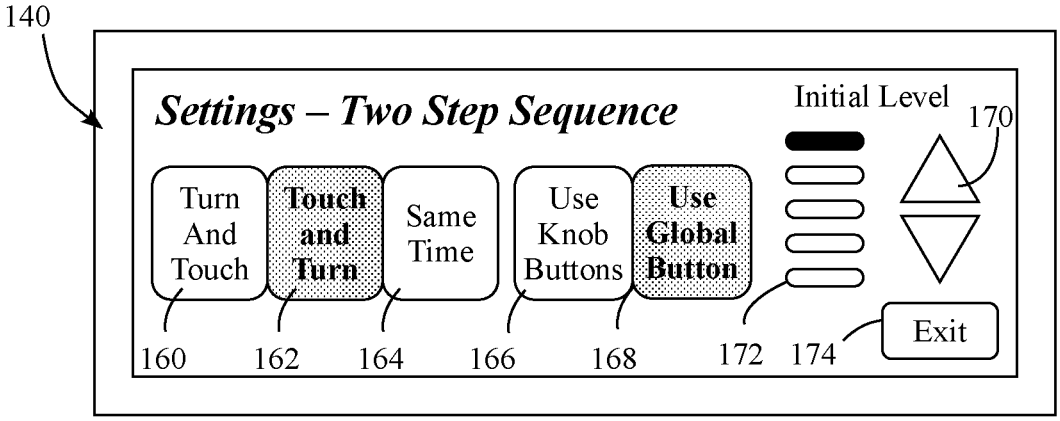
FIG. 7 is a front view of the example user interface of FIG. 6, illustrating a settings display.

A controller of the cooking appliance may, as noted above, be capable of customizing a two-step activation sequence in response to user input, e.g., through the use of a settings menu in a user interface, e.g., via selection of a "settings" button 144 on touch screen user interface 140 of FIG. 6. An example two-step sequence settings display is illustrated in FIG. 7, including soft buttons 160, 168, up/down control 170, level display 172 and exit soft button 174 (which is used to exit the settings display and return to a main display or to a higher level settings display). It will be appreciated that in other embodiments, different user interfaces may be used to select or configure a two-step activation sequence, e.g., a combination of physical buttons, or a user interface disposed on a mobile or other remote device in communication with the cooking appliance (e.g., via an app running on the device).

Soft buttons 160, 162, and 164 may operate as an activation order button group that enables a user to select from among different activation orders. Button 160 selects a "turn and touch" order where a control selector must be activated prior to activation of a touch sensor. Button 162 selects a "touch and turn" order where a touch sensor must be activated prior to activation of a control selector. Button 164 selects a "same time" order where a control selector and touch sensor must be activated simultaneously (e.g., by holding down a touch sensor and rotating a control selector prior to releasing the touch sensor).

Soft buttons 166 and 168 may operate as a touch sensor type button group that enables a user to select either burner-specific touch sensors (soft button 166) or a single global touch sensor (soft button 168). In some embodiments, when a single global touch sensor is selected, the burner-specific touch sensors may still operate as off buttons so that burner shut off is always initiated from a physical control disposed proximate a control selector.

Up/down control 170 may be used to select an initial burner output level upon ignition, with the currently selected output level being displayed via level display 172. Thus, for example, a user may be able to select a maximum output level, a minimum output level, or some output level in between to which a gas cooktop burner should default once ignited and activated.

It will be appreciated that various selections illustrated in FIG. 7 may be omitted in some embodiments, and that additional configuration settings may be used in other embodiments. Furthermore, in some embodiments, different two-step activation sequences may be configurable for each gas cooktop burner, e.g., by using the display of FIG. 7 for a burner-specific two-step activation sequence configuration. Further, in some embodiments, multiple two-step activation sequences may be stored, e.g., by a user or otherwise configured by a manufacturer, such that a user may select from among multiple stored two-step activation sequences, e.g., using a group of soft buttons assigned to different stored two-step activation sequences.

Figure 8:
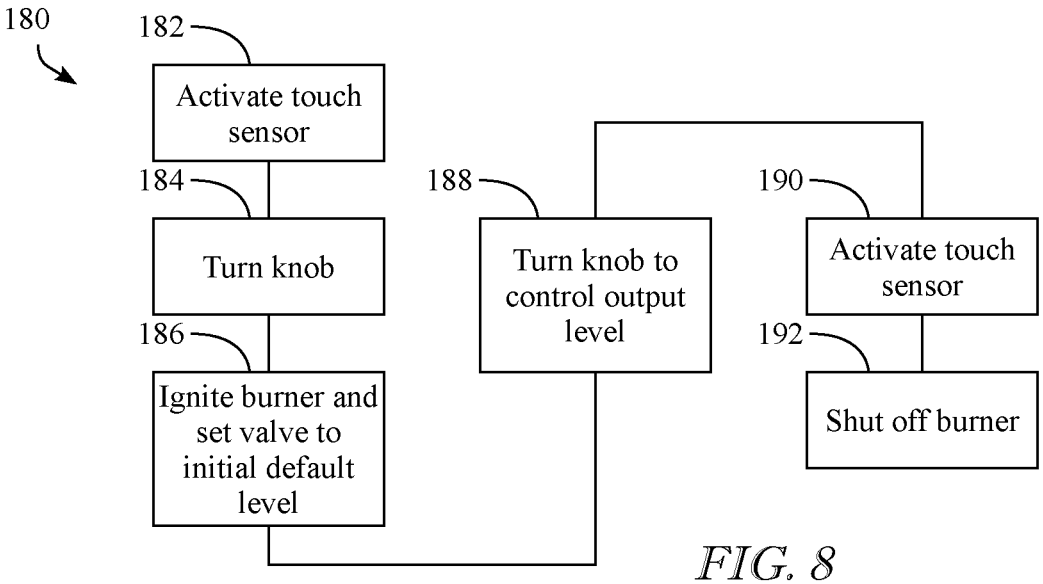
FIG. 8 is a flowchart illustrating a sequence of operations for igniting and deactivating a gas cooktop burner in accordance with various embodiments.

FIG. 8 next illustrates at 180 an example sequence of operations for igniting, using and shutting off a gas cooktop burner using a user-configurable two-step activation sequence as described herein. In this example, the two-step activation sequence uses a "touch and turn" activation order, whereby a touch sensor is required to be activated prior to activation of a control selector (in this example, a rotatable knob). Thus, by performing the two steps of activating a touch sensor (block 182) followed by activating a control knob (block 184), a controller may control the ignitor and digital gas valve for the burner to ignite the burner and set the valve to the initial default level associated with the selected two-step activation sequence (block 186). Thereafter, the user may vary the output level of the burner (block 188) until the user desires to shut off the burner. In this example, shut off of the burner is initiated in response to user activation of the touch sensor (block 190), which causes the controller to close the digital gas valve to shut off the burner (block 192).

It will be appreciated that, for example, a global touch sensor is used in the two-step activation sequence such that the touch sensor activated in block 182 is a global touch sensor, it may be desirable in some embodiments to implement the shut off of the burner in response to user activation of a burner-specific touch sensor in blocks 190-192, or alternatively in response to a burner-specific off button that is separate from a global or burner-specific touch sensor. By doing so, only a single step deactivation sequence is required to shut off the burner regardless of how the two-step activation sequence is configured in a given cooking appliance.

Figure 9:
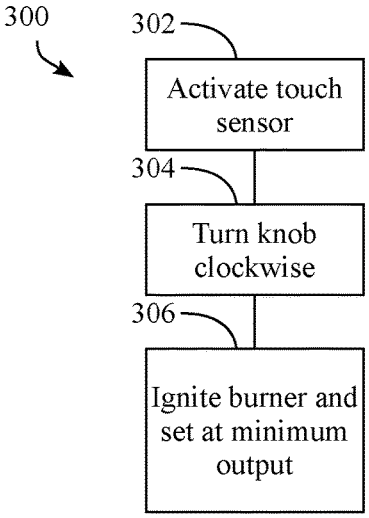
FIGS. 9-13 are flowcharts illustrating additional sequences of operations for igniting a gas cooktop burner in accordance with various embodiments.

Other two-step activation sequences that may be configured in different embodiments include, but are not limited to, the various sequences illustrated in FIGS. 9-13. FIG. 9, for example, illustrates a two-step activation sequence 300 that uses a "touch and turn" activation order that requires a touch sensor to be activated (block 302) prior to activation of a control selector (block 304), causing the burner to be ignited and initially set to a default minimum level (block 306). In this sequence, the control selector activation direction (here, turning of a knob in a clockwise direction) is required in order to ignite the burner, so it will be appreciated that in some embodiments a two-step activation sequence may be based at least in part (and may be configured in some embodiments) upon a specific direction of activation for a control selector.

Figure 10:
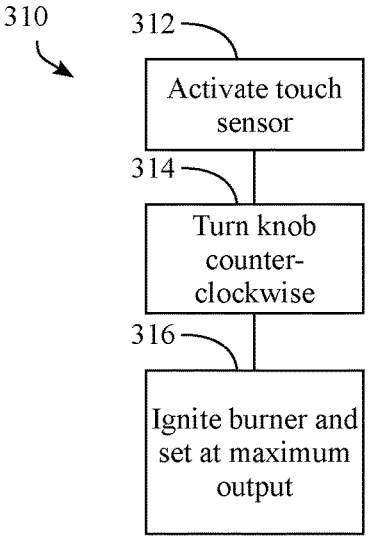

FIG. 10 illustrates another two-step activation sequence 310 that also uses a "touch and turn" activation order that requires a touch sensor to be activated (block 312) prior to activation of a control selector (block 314). In this example, however, activation of the control selector is required in a counter-clockwise direction, and the initial burner output level associated with the two-step activation sequence is a maximum output level (block 316). It will be appreciated that some two-step activation sequences in some embodiments may enable multiple output levels to be selected by a user, e.g., by combining the sequences of FIGS. 9 and 10 such that a maximum or minimum output level is initially used based upon which direction the user initially turns the control selector after activating the touch sensor.

Figure 11:
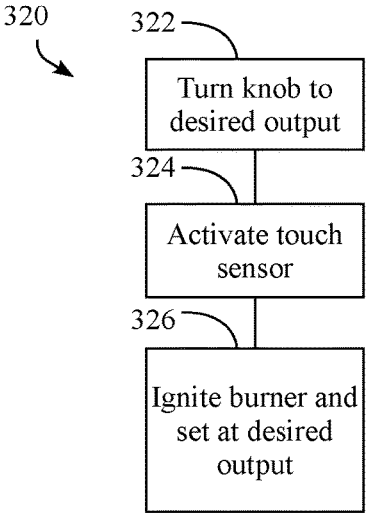

FIG. 11 illustrates another two-step activation sequence 320 that uses a "turn and touch" activation order that requires a control selector to be activated (block 322) prior to activation of a touch sensor (block 324). In addition, activation of the control selector in the first step also sets the initial burner output level, such that when the burner is ignited, the digital gas valve is initially set to the output level selected during the two-step activation sequence (block 326).

Figure 12:
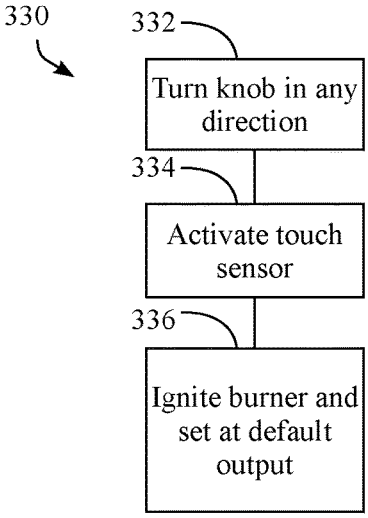

FIG. 12 illustrates yet another two-step activation sequence 330 that, similar to sequence 320 of FIG. 11, uses a "turn and touch" activation order that requires a control selector to be activated (block 332) prior to activation of a touch sensor (block 334). However, in this example, the control selector may be turned in any direction, and when the burner is ignited, the digital gas valve is initially set to a default output level (block 336), e.g., as may be selected via user configuration as discussed above in connection with FIG. 7.

Figure 13:
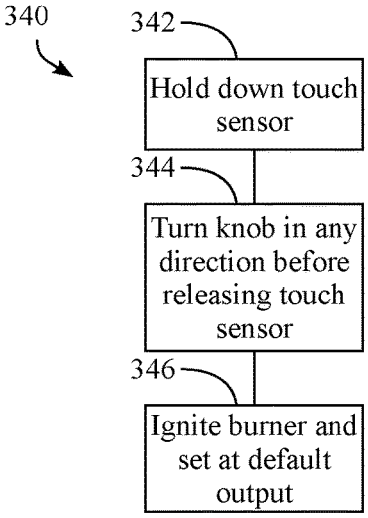

FIG. 13 illustrates another two-step activation sequence 340 that uses a "same time" activation order that requires a touch sensor to be held down (block 342) and a control selector to be turned in any direction prior to releasing the touch sensor (block 344). In this example, when the burner is ignited, the digital gas valve is initially set to a default output level (block 346), e.g., as may be selected via user configuration as discussed above in connection with FIG. 7.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A cooking appliance, comprising:

a plurality of gas cooktop burners;

a plurality of digital gas valves associated with the plurality of gas cooktop burners, each digital gas valve configured to couple an associated gas cooktop burner from among the plurality of gas cooktop burners to a gas supply;

a plurality of control selectors associated with and assigned to the plurality of gas cooktop burners and having respective outputs representative of valve positions of the digital gas valves for the associated gas cooktop burners;

one or more touch sensors;

a plurality of ignitors disposed proximate associated gas cooktop burners among the plurality of gas cooktop burners to ignite the associated gas cooktop burners; and a controller coupled to the plurality of control selectors, the one or more touch sensors, the plurality of gas valves and the plurality of ignitors, the controller configured to control the associated digital gas valve and the associated ignitor for a selected gas cooktop burner among the plurality of gas cooktop burners to ignite the selected gas cooktop burner in response to a two-step activation sequence initiated in response to user input directed to the one or more touch sensors and to the associated control selector for the selected gas cooktop burner, and the controller further configured to customize the two-step activation sequence in response to user input;

wherein the two-step activation sequence is a first two-step activation sequence, wherein customizing the first two-step activation sequence generates a second two-step activation sequence that is different from the first two-step activation sequence, and wherein the controller is further configured to, after customizing the first two-step activation sequence, control the associated digital gas valve and the associated ignitor for the selected gas cooktop burner among the plurality of gas cooktop burners to ignite the selected gas cooktop burner in response to the second two-step activation sequence initiated in response to user input directed to the one or more touch sensors and to the associated control selector for the selected gas cooktop burner.

2. The cooking appliance of claim 1, wherein the first and second two-step activation sequences are among a plurality of stored two-step activation sequences, and wherein the controller is configured to customize the two-step activation sequence in response to user input that selects a stored two-step activation sequence among the plurality of two-step activation sequences.

3. The cooking appliance of claim 1, wherein the controller is configured to customize the two-step activation sequence by changing an activation order of the one or more touch sensors and the associated control selector.

4. The cooking appliance of claim 3, wherein prior to customizing the two-step activation sequence, the two-step activation sequence includes activation of the one or more touch sensors prior to activation of the associated control selector for the selected gas cooktop burner, and wherein changing the activation order includes modifying the two-step activation sequence to include activation of the associated control selector for the selected gas cooktop burner prior to activation of the one or more touch sensors.

5. The cooking appliance of claim 3, wherein prior to customizing the two-step activation sequence, the two-step activation sequence includes activation of the associated control selector for the selected gas cooktop burner prior to activation of the one or more touch sensors, and wherein changing the activation order includes modifying the two-step activation sequence to include activation of the one or more touch sensors prior to activation of the associated control selector for the selected gas cooktop burner.

6. The cooking appliance of claim 1, wherein the controller is configured to customize the two-step activation sequence by changing an activation order of the one or more touch sensors and the associated control selector for the selected gas cooktop burner to require simultaneous activation of the one or more touch sensors and the associated control selector for the selected gas cooktop burner.

7. The cooking appliance of claim 1, wherein the one or more touch sensors includes a global touch sensor having an output representative of a permission to operate any of the plurality of gas cooktop burners.

8. The cooking appliance of claim 7, further comprising a user interface coupled to the controller, wherein the global touch sensor is a user interface control provided on the user interface.

9. The cooking appliance of claim 7, wherein the global touch sensor is a physical device disposed on a surface of the cooking appliance.

10. The cooking appliance of claim 1, wherein the one or more touch sensors includes a plurality of touch sensors for the plurality of gas cooktop burners, each touch sensor having an output representative of a permission to operate an associated gas cooktop burner among the plurality of gas cooktop burners.

11. The cooking appliance of claim 1, wherein the one or more touch sensors includes a global touch sensor having an output representative of a permission to operate any of the plurality of gas cooktop burners and a plurality of burner-specific touch sensors for the plurality of gas cooktop burners, each burner-specific touch sensor having an output representative of a permission to operate an associated gas cooktop burner among the plurality of gas cooktop burners, and wherein the controller is configured to customize the two-step activation sequence by changing between use of the global touch sensor in the two-step activation sequence and use of the burner-specific touch sensor for the selected gas cooktop burner in the two-step activation sequence.

12. The cooking appliance of claim 11, wherein the controller is further configured to shut off the selected gas cooktop burner in response to user input directed to the burner-specific touch sensor for the selected gas cooktop burner when the selected gas cooktop burner is active and regardless of whether the burner-specific touch sensor is used in the two-step activation sequence.

13. The cooking appliance of claim 1, wherein the controller is further configured to control the associated digital gas valve to set an initial output level of the gas cooktop burner in response to the two-step activation sequence.

14. The cooking appliance of claim 13, wherein the controller is configured to customize the two-step activation sequence by changing the initial output level of the gas cooktop burner for the two-step activation sequence.

15. The cooking appliance of claim 1, wherein the one or more touch sensors includes a capacitive touch sensor, a mechanical switch, an electromechanical switch or an electromechanical switch that is activated by depressing the associated control selector for the selected gas cooktop burner.

16. The cooking appliance of claim 1, wherein the associated control selector for the selected gas cooktop burner includes a rotatable knob, and wherein the two-step activation sequence includes rotation of the rotatable knob in a predetermined direction.

17. The cooking appliance of claim 1, wherein the selected gas cooktop burner is a first gas cooktop burner, and the controller is configured to control the associated digital gas valve and the associated ignitor for a second gas cooktop burner among the plurality of gas cooktop burners to ignite the second gas cooktop burner in response to a third two-step activation sequence that is different from the first two-step activation sequence.

18. A system for a two-step activation for a plurality of gas cooktop burners having associated digital gas valves coupled to a gas supply and associated ignitors disposed proximate thereto, the system comprising:

a plurality of control selectors associated with and assigned to the plurality of gas cooktop burners and having respective outputs representative of valve positions of the digital gas valves for the associated gas cooktop burners;

one or more touch sensors; and a controller coupled to the plurality of control selectors and the one or more touch sensors, the controller configured to control the associated digital gas valve and the associated ignitor for a selected gas cooktop burner among the plurality of gas cooktop burners to ignite the selected gas cooktop burner in response to a two-step activation sequence initiated in response to user input directed to the one or more touch sensors and to the associated control selector for the selected gas cooktop burner, and the controller further configured to customize the two-step activation sequence in response to user input;

wherein the selected gas cooktop burner is a first gas cooktop burner, the two-step activation sequence is a first two-step activation sequence associated with the first gas cooktop burner, and the controller is configured to control the associated digital gas valve and the associated ignitor for a second gas cooktop burner among the plurality of gas cooktop burners to ignite the second gas cooktop burner in response to a second two-step activation sequence that is different from the first two-step activation sequence.

* * * * *